US006106020A

United States Patent [19]

Leef et al.

[11] Patent Number: 6,106,020

[45] **Date of Patent: *Aug. 22, 2000**

[54] FRAUD PREVENTION METHOD AND SYSTEM

[75] Inventors: Quentin Leef, La Crescenta; John Reed, Chula Vista, both of Calif.

[73] Assignee: Kerning Data Systems, Inc., Chatsworth, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/958,988

[22] Filed: Oct. 28, 1997

[51] Int. Cl.[7] ..... B42D 15/00

[52] U.S. Cl. ..... 283/67; 235/380; 235/381; 283/57; 283/58; 283/77

[58] Field of Search ..... 283/57, 58, 77, 283/67; 235/381, 380

[56] References Cited

U.S. PATENT DOCUMENTS

| | | | |
|---|---|---|---|
| 2,462,735 | 2/1949 | Goldwater | 283/77 |
| 3,048,697 | 8/1962 | Cavanaugh et al. | 283/77 |
| 3,569,619 | 3/1971 | Simjian . | |
| 4,048,618 | 9/1977 | Hendry . | |
| 4,754,487 | 6/1988 | Newmuis . | |
| 4,865,351 | 9/1989 | Smithson et al. | 283/58 |
| 4,999,065 | 3/1991 | Wilfert | 283/77 |
| 5,157,726 | 10/1992 | Merkle et al. . | |
| 5,321,751 | 6/1994 | Ray et al. . | |
| 5,442,162 | 8/1995 | Armel | 235/381 |
| 5,513,272 | 4/1996 | Bogosian, Jr. . | |
| 5,635,012 | 6/1997 | Belluci et al. | 283/77 |
| 5,673,320 | 9/1997 | Ray et al. . | |
| 5,787,186 | 7/1998 | Schroeder | 283/77 |
| 5,816,619 | 10/1998 | Schaede | 283/67 |
| 5,832,464 | 11/1998 | Houvener et al. . | |

FOREIGN PATENT DOCUMENTS

| | | |
|---|---|---|
| 609 937 | 10/1994 | European Pat. Off. . |
| 2 322 016 | 9/1775 | France . |
| 2 671 891 | 7/1992 | France . |
| 8607480 | 12/1986 | WIPO . |

OTHER PUBLICATIONS

Patent Abstracts of Japan, Oshida Noriyuki, "Securities to Which Forgery Check is Applied," appln. No. 08021884, filed Dec. 01, 1996, EPO.

*Primary Examiner*—Andrea L. Pitts
*Assistant Examiner*—Monica S. Carter
*Attorney, Agent, or Firm*—Pillsbury Madison & Sutro LLP

[57] ABSTRACT

A method for preventing fraudulent use of a document which is intended to be used by a designated individual, by the steps of, digitally photographing the face of an individual who has possession of the document to form a digital representation of the face; processing the digital representation to generate digital printer input data; and printing a visually observable image of the face of the individual on the document, using the digital printer input data.

15 Claims, 1 Drawing Sheet

FRAUD PREVENTION METHOD AND SYSTEM

BACKGROUND OF THE INVENTION

The present invention is concerned with increasing the security of transactions involving bearer instruments and is more particularly concerned with the prevention of fraud in such transactions.

In the usual course of commerce, there are occasions when documents which entitle the bearer to receive property or money fall into the wrong hands, either through loss or theft. An individual to whom such a document is presented is confronted with the need to decide whether the bearer is the individual who is entitled to submit, or redeem, that document.

Numerous systems and techniques are available for identifying the bearer of such a document. For example, in the case of a personal check presented by an individual representing himself to be the holder of the checking account, the person to whom the check is issued can insist on being presented with some form of identification bearing a photo. If the individual presenting the check indicates that he does not have such identification with him, the intended recipient must decide whether to accept identification which does not bear a photo. If the check was stolen, along with other forms of identification, then the check may be accepted even though the individual presenting the check is not the individual named in the other forms of identification or on the check.

Similar problems exist, to a greater degree, in the case of traveler's checks. Although persons to whom traveler's checks are presented in payment of a debt can request a photo identification, which is frequently a passport when the traveler's check is used in foreign countries, it is the more common practice to accept the traveler's check if the signature placed thereon at the time the check is used to pay a debt bears a reasonable resemblance to the original signature, which had been placed on the check at the time it was issued. One reason for this practice is that merchants who accept traveler's checks are aware that the issuer of the check will honor it whether it was used by the purchaser or someone who either found or stole the check.

In the case of claim checks, such as baggage claim checks employed during air travel, there is always a concern that a claim check will fall into the wrong hands. Once this happens, if the individual who acquires the check knows the flight which was taken by the individual who originally had the check, it is possible to obtain a piece of luggage belonging to that individual. Even in airports which monitor the baggage claim area, if an individual possesses a claim check matching the tag on the baggage in the individual's possession, their right to that piece of luggage will not be questioned.

In the case of checking accounts, when an individual opens a new account, they are initially given a supply of non-personalized checks for use until checks bearing at least their name, and usually also their address, can be printed and supplied. These initial, or "starter" checks are frequently not accepted by many businesses because they do not bear any printed identification of the account holder.

Even with regard to checks that are personalized, when an individual, and in particular an individual who is not the account holder, cashes a check at the bank in which the account is held and the bank teller determines that the account on which the check is drawn contains sufficient funds to cover the check, it is not uncommon for the teller to pay that check without adequately confirming the identity of the individual presenting the check for payment or the authenticity of the check.

BRIEF SUMMARY OF THE INVENTION

It is a primary object of the present invention to provide greater security in transactions of the type described above in a manner which simplifies the task of identifying an individual.

A more specific object of the invention is to utilize existing technological capabilities to place on a document an easily observable identification of the individual.

A more specific object of the invention is to place on the document a printed image of the individual's face.

The above and other objects are achieved, according to the present invention, by a method for preventing fraudulent use of a document which is intended to be used by a designated individual, the method comprising: digitally photographing the face of an individual who has possession of the document to form a digital representation of the face; processing the digital representation to generate digital printer input data; and printing a visually observable image of the face of the individual on the document, using the digital printer input data.

DETAILED DESCRIPTION OF THE INVENTION

Figure 1:
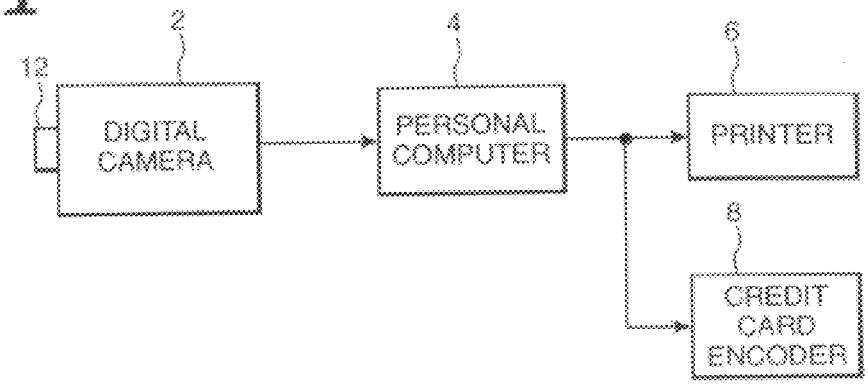
FIG. 1 is a block diagram illustrating a system for carrying out the present invention.

One exemplary embodiment of a system for implementing the invention is shown in block diagram form in FIG. 1. This system is composed essentially of a digital camera 2, a personal computer 4 and a printer 6.

Digital camera 2 is positioned and, if necessary, focused to capture an image of the face of an individual when that individual is at a defined position in front of camera lens 12. As is known, when digital camera 2 is triggered, an image of the scene as viewed by lens 12 is formed on a light sensitive surface providing a matrix of light sensitive elements. The quantity, or intensity, of light impinging on each element is converted into an electrical signal and the electrical signals produced by each element are converted into digital form. The resulting digital representations of the signals produced by successive elements are conducted to computer 4.

The technology employed for creating such an image and converting it into digital form is already well known in the art and is employed in commercially available digital cameras, any one of which may be employed as camera 2 in a system for implementing the invention. For example, cameras of this type are marketed under the trade names Connectix® and Panasonic®.

Computer 4 may be constituted by any commercially available personal computer controlled by a stored program which is capable of formatting the digital image data provided by camera 2 for printing on a paper substrate. This can be any one of a number of commercially available graphics programs having the capability of formatting the type of image data provided by a digital camera. A large number of programs which are capable of converting image data provided by a digital camera into a format that can be supplied to a printer are already on the market. Virtually any one of these programs could be utilized in the practice of the present invention. One exemplary program is marketed under the name Image Alchemy® by Hand-Made Software Inc.

Such programs are user configurable to print an image having a selected size at a selected location on a paper substrate.

Printer 6 can be any commercially available computer printer, such as a laser printer, an ink jet printer, a direct thermal printer, a thermal transfer printer, or any other non-impact printer. One exemplary printer would be a HP Laser Jet® printer. However, this printer is cited only as a non-limiting example.

Preferably, the printer is equipped with an envelope feeder capable of feeding individual checks.

It will be appreciated from the descriptions presented above that a system for implementing the present invention can be assembled with commercially available and relatively inexpensive devices. Therefore, such systems would be economically accessible to a wide variety of business institutions, and particularly banks, retail establishments, check cashing establishments, etc.

Such a system may be utilized in a variety of ways in accordance with the invention.

To cite a first example, the system may be utilized in a bank branch when a checking account is opened. At that time, in addition to obtaining all of the necessary personal information about the checking account holder, the holder's face will be photographed by camera 2 and the resulting digital image data will be stored in personal computer 4. This image data can be utilized in at least two ways. Firstly, it can be saved to disk or transmitted via a network or modem to a facility where the holder's personal checks will be printed. At that location, along with the conventional check printing operation, the digital image data can be properly formatted to print an observable image of the face of the holder at a selected location on each check.

According to a second possibility, at the location where the account is opened, the observable image may be printed on each one of a set of starter checks which may be immediately used by the account holder.

Typically, starter checks are printed with only the name of the bank, serial numbers and a preselected account number. Many businesses will refuse to accept such checks because they lack any identification of the account holder. If an observable image of the account holder were present on each such check, businesses would be more willing to accept them.

In further accordance with the invention, computer 4 could be additionally provided with the appropriate software for printing fully personalized checks. It would then be possible to immediately print an initial set of checks for a new account holder bearing not only an image of the account holder but also the usual identifying information, including the holder's name and address. These checks may additionally be printed with magnetically readable, or MICR (Magnetic Ink Character Recognition), data of the type currently provided on bank checks. Thus, a complete set of personalized checks can be produced as soon as a checking account is opened.

The present invention further permits added security to be achieved when a check is cashed at a bank branch by a payee who is not known to the teller and in particular is not a holder of an account at that bank. In this case, before the check is cashed, the payee's face is photographed by the digital camera, the resulting digital image data is processed in personal computer 4, the check is positioned in printer 6 and an observable image of the payee's face is printed on the check.

This procedure serves a number of purposes. Firstly, if the individual cashing the check is not the intended payee or if the check is fraudulently issued, knowledge that his picture will be on the check may very well discourage him from attempting to cash it. Secondly, if the person cashing the check does proceed with the transaction, his image on the check can be used to identify him.

The method according to the invention can be further employed to place on traveler's checks a visibly observable image of the face of the purchaser thereof. Since traveler's checks are frequently treated almost like currency, and those who accept traveler's checks frequently do not ask for identification or carefully compare the two signatures thereon, an observable image of the purchaser of a traveler's check can provide the person who accepts such check as payment with increased assurance that the check has, in fact, been presented by the person who purchased that check.

Figure 2:
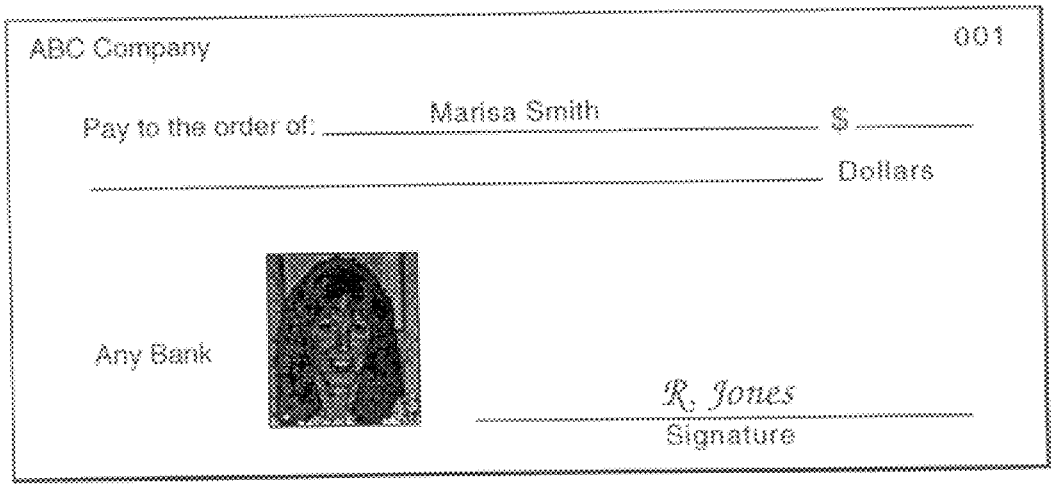
FIG. 2 is a pictorial view showing one exemplary document provided with an image according to the present invention.

FIG. 2 is a pictorial view of an exemplary business check which was made out to Marissa Smith and which was presented to the account holder's bank to be cashed. Prior to cashing, the woman's face was photographed and the resulting digital image was printed on the check as shown. It should be noted that the image appearing on FIG. 2 was printed in a system using a printer which produced a resolution of 300 dots per inch. The resolution achieved will depend on the capabilities of the printer employed by a user. Most modern day printers have a substantially higher resolution so that images produced according to embodiments of the invention, employing currently available equipment, will have a substantially higher resolution.

The invention can be further implemented to provide an observable image of the face of an individual who checks an article for storage or in connection with airline travel. For example, the equipment shown in FIG. 1 could be disposed at an airline baggage check in counter, where the face of the individual who is checking one or more pieces of luggage is photographed by camera 2, the digital image is processed in computer 4 and an observable image based on that digital image data is printed on at least one portion of a baggage check. Such a baggage check includes a first portion which is affixed to the baggage and a second portion which is separated from the first portion and given to the traveler. Then, when the article of luggage is claimed by the traveler at his destination, the observable image can be inspected by a security agent before the traveler is allowed to leave the baggage claim area.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A method for preventing fraudulent use of a document which is intended to be presented in a transaction by a designated individual at a location for authentication; said method comprising:

photographing a face of a presenting individual who has possession of the document to form a digital representation of the face of the presenting individual contemporaneous with the presenting individual's presentation of the document for authentication at the location, wherein the face of the presenting individual is photographed at the location for authentication during the transaction;

processing the digital representation to generate digital printer input data; and printing a visually observable image of the face of the presenting individual on the document, using the digital printer input data.

2. The method according to claim 1 wherein the presenting individual photographed in said step of photographing is the designated individual.

3. The method according to claim 2 wherein the document is a bank check for an account held by the designated individual, or a traveler's check purchased by the designated individual.

4. The method according to claim 1 wherein the document is a negotiable instrument and said steps of digitally photographing, processing and printing are carried out when the instrument is presented for payment.

5. The method according to claim 4 wherein the instrument is a bank check assigned to a bank account and said step of digitally photographing comprises digitally photographing the face of an individual who presents the check for payment and deposit and who is other than the holder of the bank account.

6. The method according to claim 1 wherein said step of printing is performed with a non-impact printer.

7. A system for authenticating instruments and preventing fraud, the system comprising:

a camera for capturing a digital image of a first individual having possession of an instrument contemporaneous with a presentation of the instrument by the first individual in a transaction with a second individual at a location for authentication of the instrument, wherein the digital image is captured at the location for authentication during the transaction;

a computer for receiving, processing, formatting, and storing the digital image of the first individual; and a printer for printing the stored digital image of the first individual onto the instrument to create a record of the identity of the first individual.

8. The system of claim 7, wherein the printer is at least one of a laser printer, a direct thermal printer, and a thermal transfer printer, and further comprising a printer for printing magnetic ink character recognition data onto the instrument.

9. The system of claim 7, wherein the instrument is at least one of: (i) a bank check for an account held by the first individual; and (ii) a traveler's check purchased by the first individual.

10. A system for managing items submitted by an individual for storage or transportation at a location receiving items for storage or transportation, the system comprising:

a camera for photographing a face of the individual at the location for receiving items for storage or transportation contemporaneous with the individual's submission of the item to form a digital representation of the face of the individual, wherein the face of the individual is photographed at the location for receiving items for storage or transportation when the individual submits the item for storage or transportation;

a computer for processing the digital image to generate digital printer input data; and a printer for printing a visually observable image of the face of the individual submitting the item onto a tag affixed to, or a claim check for the item using the digital printer input data.

11. A computer readable medium for use in conjunction with a camera and a printer at a location for authentication of a document which is intended to be presented in a transaction by a designated individual, the computer readable medium having computer readable instructions encoded thereon for performing the following:

receiving image data representative of a photograph of a face of a presenting individual who has possession of the document taken contemporaneous with the presenting individual's presentation of the document at the location for authentication, wherein the photograph is taken at the location for authentication during the transaction;

forming instructions readable by the printer for printing the face of the presenting individual onto the document based upon the image data; and transmitting the instructions to the printer.

12. The computer readable medium of claim 11, wherein the computer readable medium further includes computer readable instructions encoded thereon for forming instructions readable by the printer for printing the face of the presenting individual onto a bank check for an account held by the designated individual or a traveler's check purchased by the designated individual.

13. The computer readable medium of claim 11, wherein the document is a negotiable instrument and the computer readable medium includes computer readable instructions encoded thereon for performing the steps of receiving the image data, forming the instructions readable by the printer and transmitting the instructions contemporaneous with presentation of the instrument for payment.

14. A computer readable medium for use in conjunction with a camera and a printer at a location for receiving an item to be stored or transported from an individual submitting the item for storage or transportation, the computer readable medium having computer readable instructions encoded thereon for performing the following:

receiving image data representative of a photograph of a face of the individual taken contemporaneous with the individual's submission of the item for storage or transportation;

forming instructions readable by the printer for printing the face of the individual onto a tag affixed to, or a claim check for the item based upon the image data; and transmitting the instructions to the printer.

15. A method for managing items submitted by an individual for storage or transportation at a location receiving items for storage or transportation, the method comprising:

photographing a face of the individual at the location for receiving items for storage or transportation contemporaneous with the individual's submission of the item to form a digital representation of the face, wherein the face of the individual is photographed at the location for receiving items for storage or transportation when the individual submits the item for storage or transportation;

processing the digital representation to generate digital printer input data; and printing a visually observable image of the face of the individual submitting the item onto a tag affixed to, or a claim check for the item using the digital printer input data.

* * * * *